US008814768B1

(12) United States Patent
Yang et al.

(10) Patent No.: US 8,814,768 B1
(45) Date of Patent: Aug. 26, 2014

(54) STABILITY EXERCISE DEVICE

(71) Applicants: Seong Sam Yang, Los Angeles, CA (US); Timothy Nugent, Santa Monica, CA (US)

(72) Inventors: Seong Sam Yang, Los Angeles, CA (US); Timothy Nugent, Santa Monica, CA (US)

( * ) Notice: Subject to any disclaimer, the term of this patent is extended or adjusted under 35 U.S.C. 154(b) by 80 days.

(21) Appl. No.: 13/930,257

(22) Filed: Jun. 28, 2013

(51) Int. Cl.
*A63B 21/00* (2006.01)
*A63B 26/00* (2006.01)

(52) U.S. Cl.
CPC ..... *A63B 26/003* (2013.01)
USPC ..... 482/147; 482/146; 482/148; 482/121

(58) Field of Classification Search
USPC ..... 482/83, 85–87, 89, 90
See application file for complete search history.

(56) References Cited

U.S. PATENT DOCUMENTS

| | | | | | |
|---|---|---|---|---|---|
| 185,322 | A | * | 12/1876 | Hemelright | 220/755 |
| 478,166 | A | | 7/1892 | Madsen | |
| 1,546,506 | A | * | 7/1925 | Naysmith | 606/237 |
| 1,565,484 | A | * | 12/1925 | McWhirter | 482/146 |
| 1,671,096 | A | * | 5/1928 | Anderson | 482/79 |
| 2,114,790 | A | * | 4/1938 | Venables | 482/105 |
| 2,242,748 | A | | 5/1941 | Fulwiler | |
| 2,283,595 | A | | 5/1942 | Banister | |
| 2,733,065 | A | * | 1/1956 | Barkschat | 482/132 |
| 3,377,722 | A | * | 4/1968 | Downing | 36/7.8 |
| 3,472,508 | A | * | 10/1969 | Baker et al. | 482/79 |
| 4,191,371 | A | | 3/1980 | Armer, Jr. | |
| 4,801,140 | A | * | 1/1989 | Bergeron | 482/146 |
| 4,892,305 | A | | 1/1990 | Lynch | |
| 5,735,776 | A | | 4/1998 | Swezey | |
| 5,810,700 | A | | 9/1998 | Orcutt | |
| 5,897,474 | A | | 4/1999 | Romero | |
| 6,551,225 | B1 | * | 4/2003 | Romero | 482/146 |
| 6,575,885 | B1 | * | 6/2003 | Weck et al. | 482/147 |
| 6,719,676 | B1 | | 4/2004 | Hsu | |
| 6,872,175 | B2 | | 3/2005 | Lin | |
| 7,288,055 | B2 | | 10/2007 | Blaum | |
| 7,344,488 | B2 | * | 3/2008 | Weck et al. | 482/147 |
| 7,563,216 | B1 | * | 7/2009 | Kest | 482/141 |
| 7,585,262 | B1 | * | 9/2009 | Vayntraub | 482/141 |
| 7,678,027 | B2 | | 3/2010 | Sanghavi | |
| D627,015 | S | * | 11/2010 | Senegal | D21/689 |
| 7,909,746 | B2 | * | 3/2011 | Gant | 482/141 |
| 8,105,218 | B1 | * | 1/2012 | Vayntraub | 482/141 |
| 8,267,845 | B2 | * | 9/2012 | Taylor et al. | 482/140 |
| 2005/0009677 | A1 | * | 1/2005 | Yang | 482/142 |
| 2005/0043149 | A1 | | 2/2005 | McKenzie | |
| 2005/0245363 | A1 | | 11/2005 | Shumrick | |
| 2005/0245372 | A1 | * | 11/2005 | Mylrea et al. | 482/148 |
| 2006/0287173 | A1 | | 12/2006 | Guadagno | |
| 2010/0261590 | A1 | * | 10/2010 | Fares | 482/131 |
| 2013/0184131 | A1 | * | 7/2013 | Doyle | 482/139 |
| 2013/0190150 | A1 | * | 7/2013 | Delisle | 482/141 |

* cited by examiner

*Primary Examiner* — Loan H Thanh
*Assistant Examiner* — Rae Fischer
(74) *Attorney, Agent, or Firm* — Brennan C. Swain, Esq.; Jeffer Mangels Butler & Mitchell LLP

(57) ABSTRACT

An exercise device that includes a base member that includes an upper surface and a cushion seat portion extending downwardly therefrom and a handle cavity defined in and extending downwardly from the upper surface. The device also includes a cushion member attached to the cushion seat portion. The cushion seat portion has a generally convex shape. A handle portion secured to the base member and spanning the handle cavity, and at least a first binding member that is secured to the base member and is configured to secure a user's foot to the upper surface of the base member.

17 Claims, 6 Drawing Sheets

STABILITY EXERCISE DEVICE

FIELD OF THE INVENTION

The present invention relates to an exercise device, and more particularly to a stability exercise device for a user's hands and/or feet.

BACKGROUND OF THE INVENTION

Stability and core training have developed into one of the most important concepts in fitness training. A primary benefit of exercise ball training, as opposed to exercising on a hard flat surface, is that the body responds to the instability of the ball to remain balanced thereby engaging many more muscles. Those muscles become stronger over time to keep balanced. However, many core training devices, such as stability balls are large and are not specifically targeted for use with a user's limbs.

SUMMARY OF THE PREFERRED EMBODIMENTS

In accordance with a first aspect of the present invention there is provided an exercise device that includes a base member that includes an upper surface and a cushion seat portion extending downwardly therefrom and a handle cavity defined in and extending downwardly from the upper surface. The device also includes a cushion member attached to the cushion seat portion. The cushion seat portion has a generally convex shape. A handle portion secured to the base member and spanning the handle cavity, and at least a first binding member that is secured to the base member and is configured to secure a user's foot to the upper surface of the base member. In a preferred embodiment, the base member includes a rim portion that has an outer circumferential surface, and the first binding member is movable between a stowed position where the first binding member extends circumferentially about a portion of the outer circumferential surface and a deployed position where the first binding member extends over the upper surface of the base member and is configured to secure a user's foot to the upper surface of the base member. Preferably, the exercise device also includes a second binding member that is movable between a stowed position where the second binding member extends circumferentially about a portion of the outer circumferential surface and a deployed position where the second binding member extends over the upper surface of the base member and is configured to secure a user's foot to the upper surface of the base member. In a preferred embodiment, the first binding member and second binding member oppose one another about the outer circumferential surface when in a stowed position. Preferably, the base member includes a seat flange extending circumferentially outwardly from the rim portion and the first and second binding members rest on the seat flange when the first and second binding members are in the stowed position.

In a preferred embodiment, the base member includes a lower base portion secured to an upper base portion and the handle cavity is defined in the upper base portion and the cushion member is secured to the lower base portion. The cushion member includes an inner surface having a channel defined therein, and the lower base portion includes a cushion member flange extending circumferentially therearound. The cushion member flange is received in the channel. Preferably, the upper base portion includes a generally convex protrusive portion extending downwardly therefrom that is matingly received in a cushion seat recess defined in the lower base portion. In a preferred embodiment, the base member includes opposing handle connection recesses defined on opposite sides of the handle cavity. The opposite ends of the handle are received in the opposing handle connection recesses, and, as a result, the upper surface of the handle is generally flush with an upper surface of the base member. Preferably, the cushion member is generally dome-shaped.

In accordance with another aspect of the present invention there is provided a method of exercising that includes providing an exercise device, grasping the exercise device by a handle portion, performing a first exercise, releasing the handle portion, placing a foot on an upper surface of the base member, securing the foot thereto with a first binding member, and performing a second exercise. The exercise device includes a base member that has a handle cavity defined therein that is open to the upper surface thereof, and a cushion member extending downwardly therefrom that has a generally convex shape. The exercise device also includes the handle portion secured to the base member and that spans the handle cavity, and at least a first binding member secured to the base member.

In a preferred embodiment, the exercise device further includes a second binding member and the method further includes pivoting the first and second binding members from the stowed position to the deployed position before the step of placing a foot on the upper surface of the base member.

In accordance with yet another aspect of the present invention, there is provided an exercise device that includes a base member having an upper base portion that includes an upper surface, a rim portion having an outer circumferential surface, and a downwardly extending generally convex protrusive portion. A handle cavity is defined in the upper base portion. The base member also includes a lower base portion that includes a cushion seat recess that matingly receives the protrusive portion of the upper base portion, a cushion member flange, and a cushion seat portion extending downwardly therefrom. The exercise device also includes a cushion member that has an inner surface and an outer surface. The inner surface includes a channel that receives the cushion member flange to secure the cushion member to the lower base portion. The inner surface is in contact with the cushion seat portion of the lower base portion, and the cushion portion has a generally convex shape. The exercise device also includes a handle portion secured to the base member and that spans the handle cavity, and first and second binding members pivotably secured to the base member. The first and second binding members are movable between a stowed position where the first and second binding members extend circumferentially about a portion of the outer circumferential surface and a deployed position where the first and second binding members extend over the upper surface of the base member and are configured to secure a user's foot to the upper surface of the base member.

Generally, in use a user secures one or more devices to their hands or feet to mimic unstable conditions while in motion, with each limb operating separately. When worn on both feet, the device allows the user to balance on both feet, on one foot, run, walk or otherwise exercise while wearing the device(s).

The invention, together with additional features and advantages thereof, may be best understood by reference to the following description.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
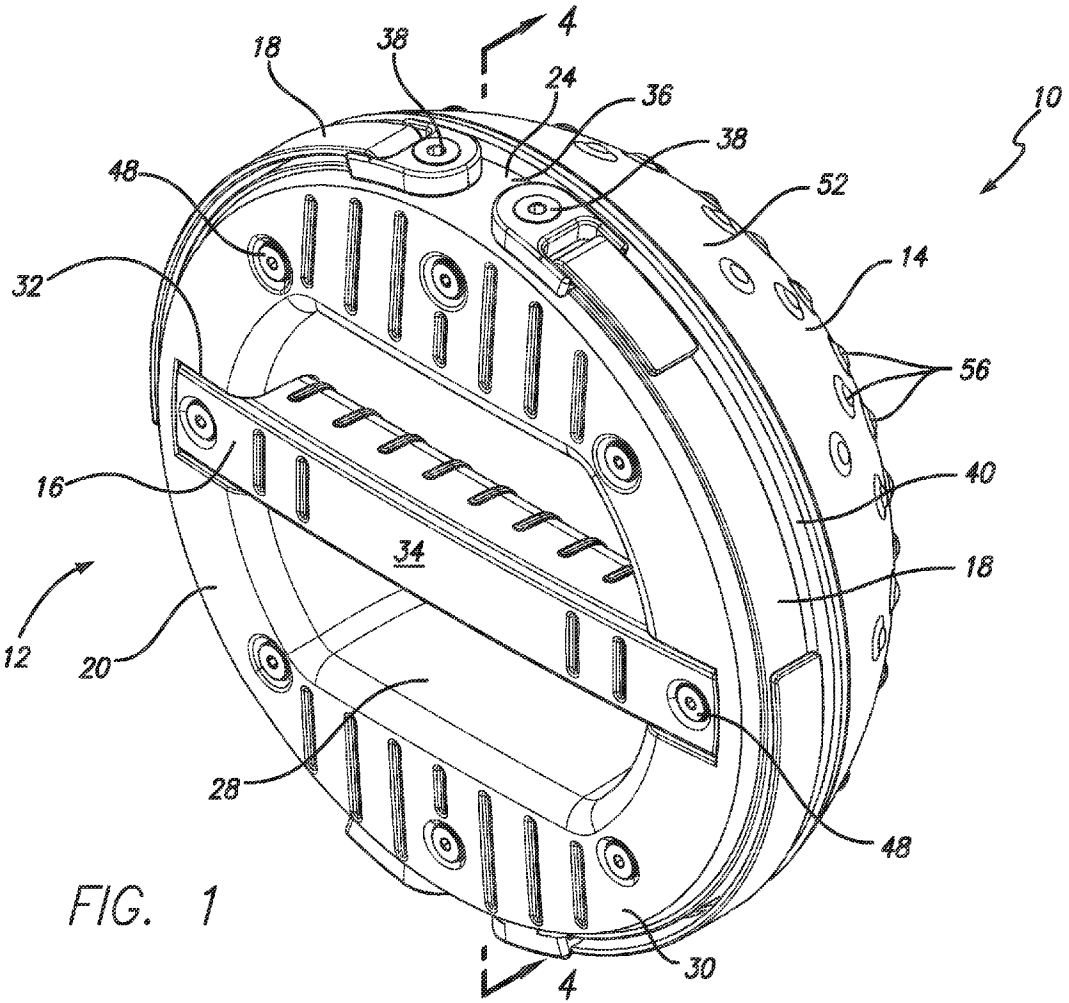
FIG. 1 is a perspective view of a stability exercise device in accordance with an embodiment of the present invention.
Figure 2:
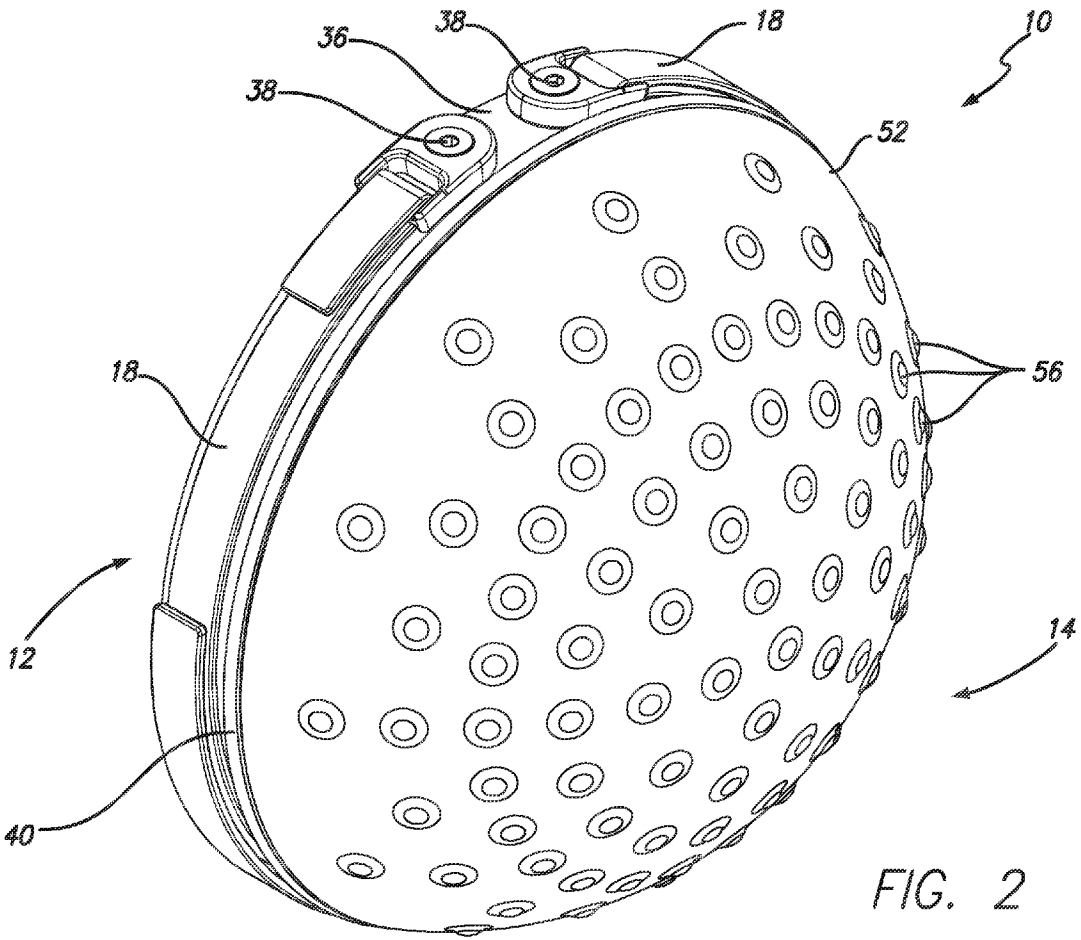
FIG. 2 is another perspective view of the stability exercise device of FIG. 1.

The following description and drawings are illustrative and are not to be construed as limiting. Numerous specific details are described to provide a thorough understanding of the disclosure. However, in certain instances, well-known or conventional details are not described in order to avoid obscuring the description. References to one or an other embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Referring now to the drawings, wherein the showings are for purposes of illustrating the present invention and not for purposes of limiting the same, FIGS. 1-6 show an exercise device 10 that generally includes a base member 12, a cushion member 14, a handle 16 and bindings 18. In a preferred embodiment, the base member 12 includes an upper base portion 20 and a lower base portion 22. However, in another embodiment, the base member 12 can be a unitary piece. In another embodiment, the base member 12 and cushion member 14 can be unitary.

As shown in FIG. 1, in a preferred embodiment, the upper base portion 20 includes a rim portion 24 and a protrusive portion 26 extending downwardly therefrom. The protrusive portion 26 at least partially defines a handle cavity 28 that is defined in the upper surface 30 of the upper base portion 20. Handle 16 spans the handle cavity 28, as is best shown in FIG. 1. In a preferred embodiment, upper base portion 20 includes opposing handle connection recesses 32 that receive the opposite ends of the handle 16 and allow the upper surface 34 of the handle 16 to be generally flush with the upper surface 30 of the upper base portion 20. In another embodiment, the upper base portion 20 (or the base member 12 generally) can include the handle 16 formed integrally therewith.

Figure 3:
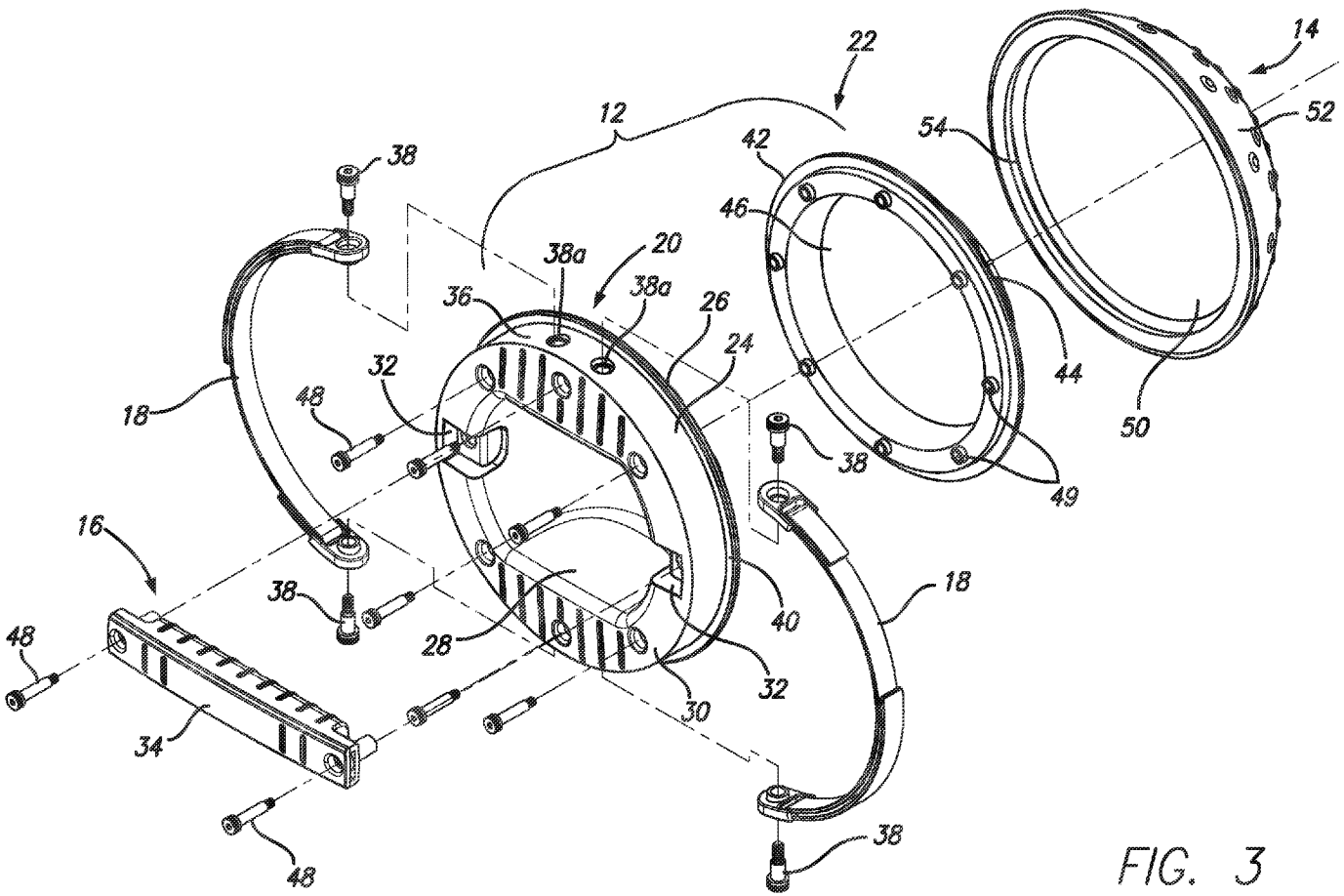
FIG. 3 is an exploded perspective view of the stability exercise device of FIG. 1.
Figure 6:
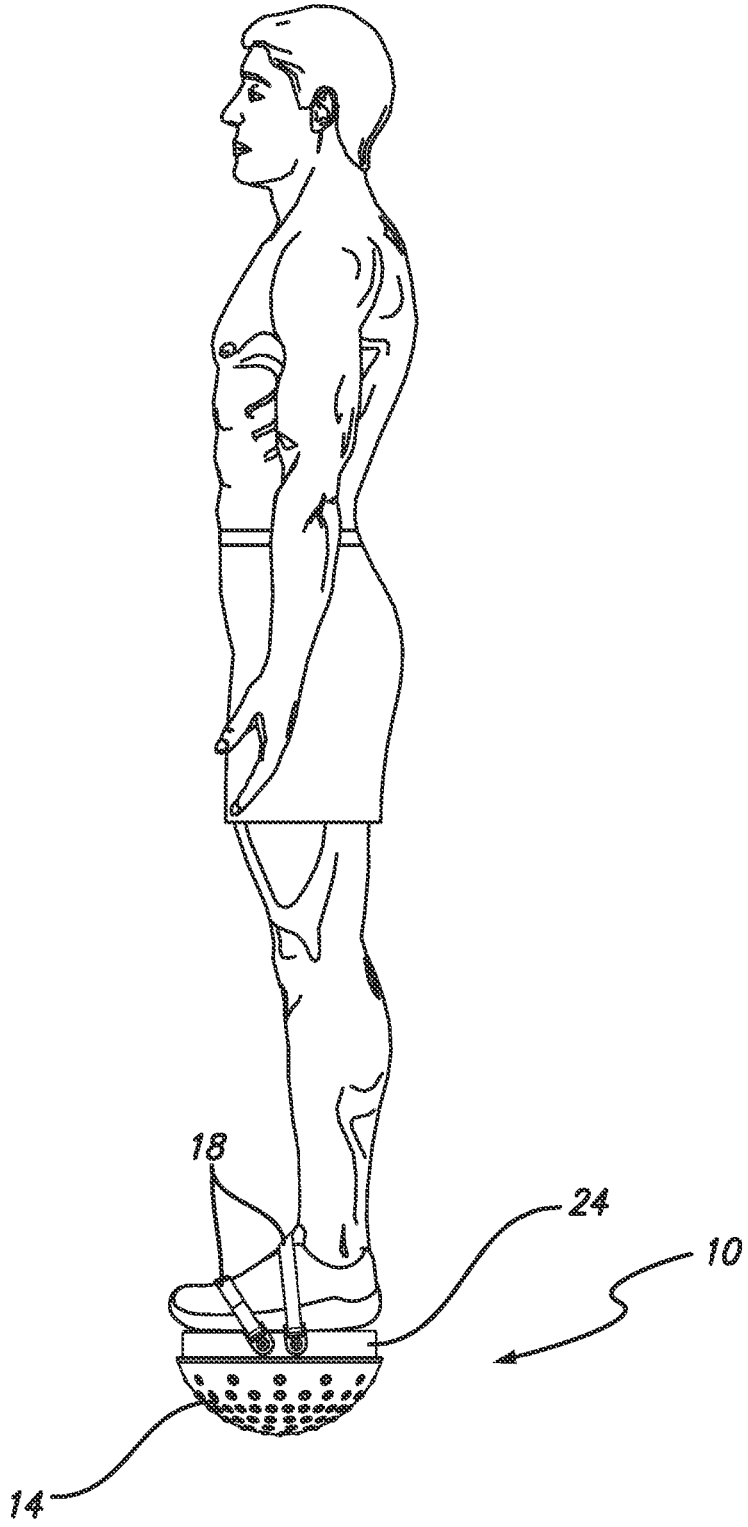
FIG. 6 is a side elevational view of a user with the stability exercise device of FIG. 1 strapped to his feet.

In a preferred embodiment, the bindings 18 are pivotally secured to an outer circumferential surface 36 of the rim portion 24. As shown in the figures, in a preferred embodiment, the bindings 18 are adjustable straps whose opposite ends are pivotally secured via a pivot pin 38 to the outer circumferential surface 36 of the rim portion 24. As shown in FIG. 3, in a preferred embodiment, the base member 12 includes two bindings 18 that extend almost 180 degrees around the circumference of the upper base portion 20. The pivot pins 38 allow the straps to be pivoted or moved between a stowed position, as shown in FIG. 1 and a deployed position, as shown in FIG. 6. In the deployed position, the bindings 18 are configured to secure a user's foot to the upper surface 30 of the base member 12. In a preferred embodiment, the pivot pins 38 are threaded fasteners that are received in openings **38*a* in the outer circumferential surface 36. However, in another embodiment, the pivot pins 38 can be permanently attached to the base member 12 or can be any pivotal connection between the bindings 18 and the base member 12**.

In a preferred embodiment, the upper base portion 20 includes a seat flange 40 on which the bindings 18 are seated when in the stowed position. It will be appreciated that other bindings are within the scope of the present invention. In another embodiment, the bindings can be straps that are permanently in the deployed position and that extend above and over the upper surface 30 of the base member 12. Any binding that secures a user's foot to the base member is within the scope of the present invention. In a preferred embodiment, the bindings 18 include Velcro adjustability. In other embodiment adjustability can be provided by snaps, buttons, clasps or other adjustment means.

Figure 4:
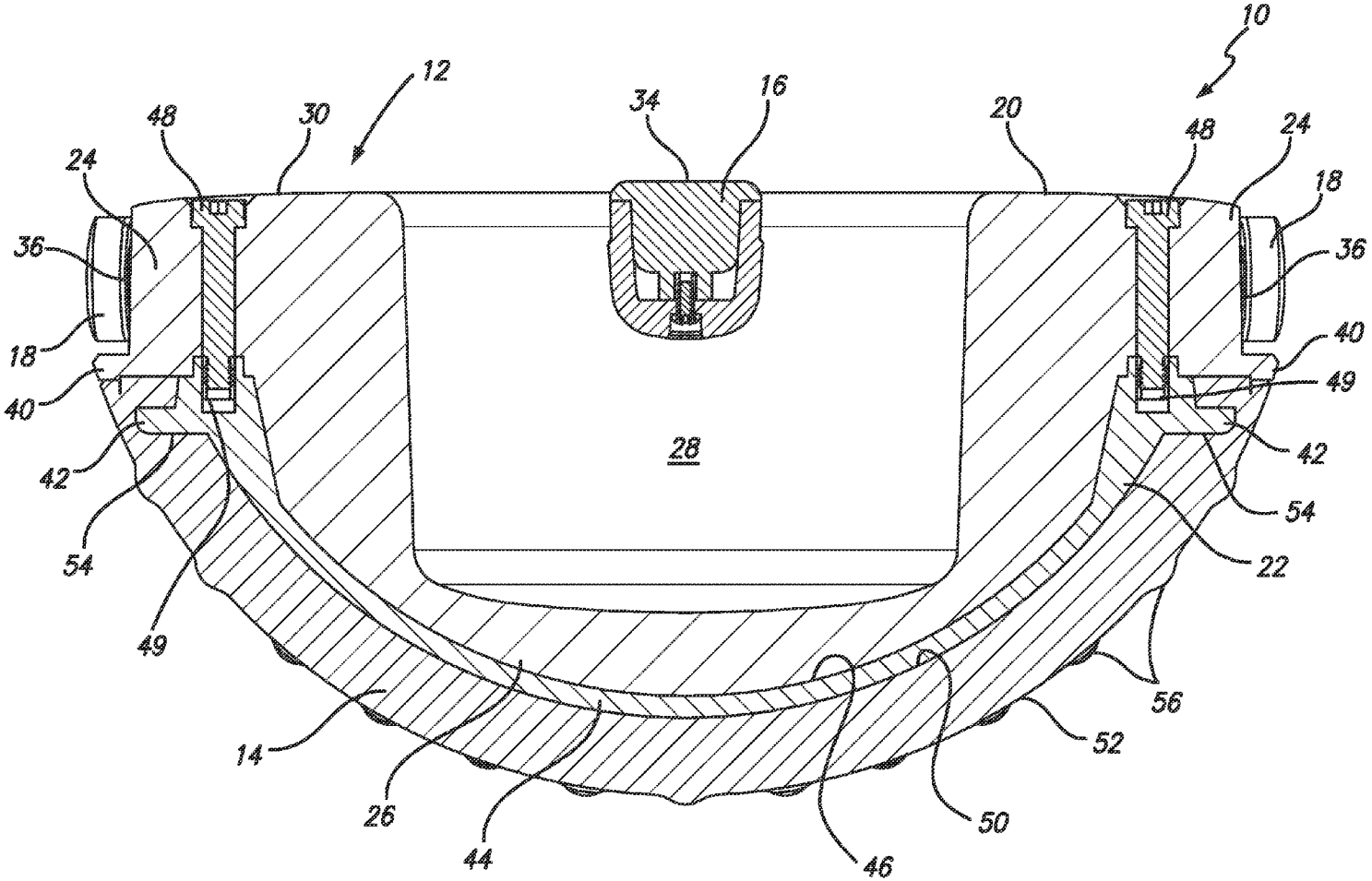
FIG. 4 is a cross-sectional view of the stability exercise device taken along line 4-4 of FIG. 1.
Figure 5:
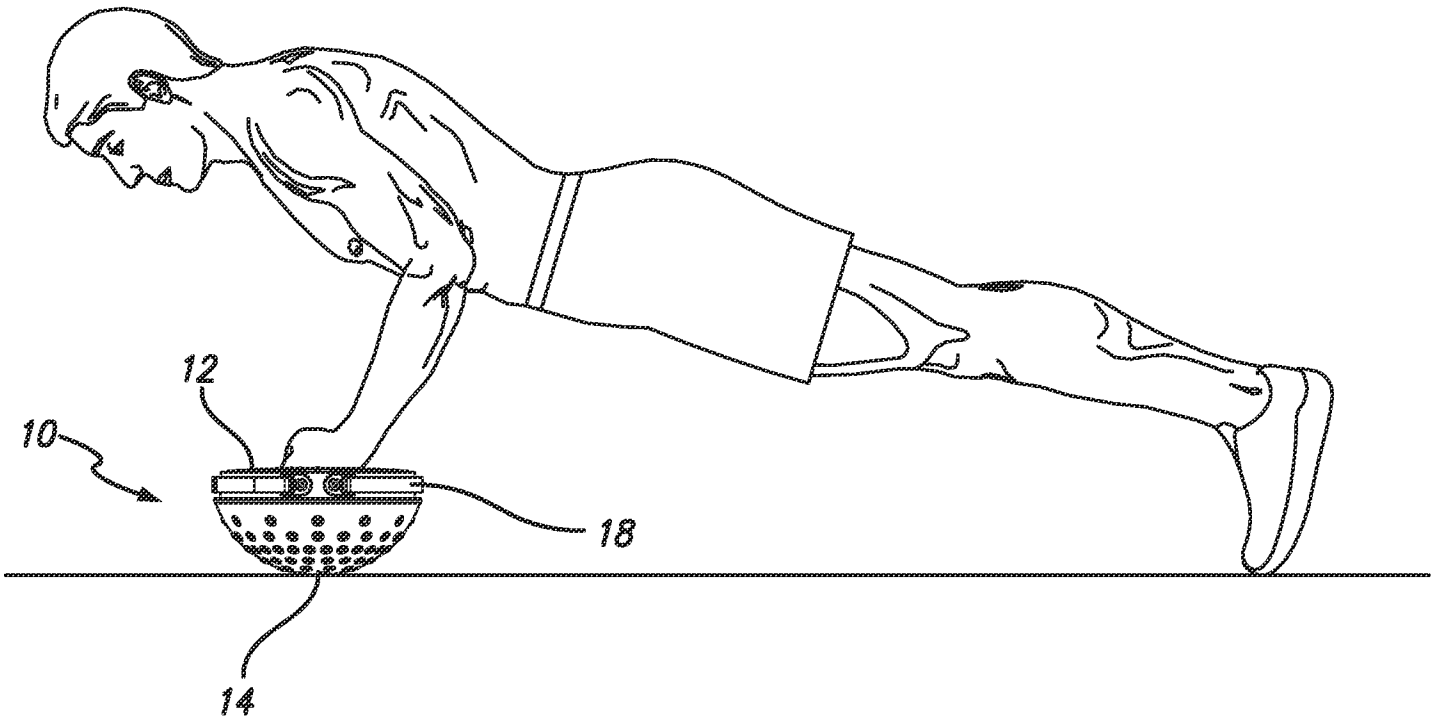
FIG. 5 is a side elevational view of a user doing push ups with the stability exercise device of FIG. 1.

With reference to FIGS. 3-5, in a preferred embodiment, the lower base portion 22 includes a cushion member flange 42 extending circumferentially outwardly therefrom and a cushion seat portion 44 that is generally dome shaped, extends downwardly and defines a cushion seat recess 46. As shown in FIG. 5, in a preferred embodiment, the lower base portion 22 is secured to the upper base portion 20 via threaded fasteners 48 or the like. As shown in FIG. 4, in a preferred embodiment, the threaded fasteners 48 are received in openings 49 in the lower base portion 22. Any method for securing the lower base portion 22 is secured to the upper base portion 20 is within the scope of the present invention, e.g., glue, adhesive, sonic welding, rivets or other fasteners, etc. As shown in FIG. 4, when the lower base portion 22 is secured to the upper base portion 20, the protrusive portion 26 is received in the cushion seat recess 46.

Cushion member 14 comprises a generally convex or domed shape. In another embodiment, the cushion member can be curved in one direction, but straight in another, to provide instability in one direction, but stability in another, similar to a rocker. Cushion member includes an inner surface 50 and an outer surface 52. In a preferred embodiment, a channel 54 is defined in the inner surface. As shown in FIG. 4, cushion member flange 42 is received in channel 54, to secure cushion member 14 to base member 12, and, in particular, lower base portion 22.

In a preferred embodiment, the outer surface 52 of cushion member 14 includes bumps 56 thereon, which, when the device 10 is in use, adds to the instability. Furthermore, in a preferred embodiment, the cushion member 14 is made of a material that is softer than the material from which the base member 12 is made. This provides instability during use. The cushion member 14 can be made of any soft material known in the art, including but not limited to rubber, plastic, gel, fluid, air, cloth, or any soft textile or synthetic material. The cushion is preferably sized and shaped similarly to the base, but may be smaller or take a different shape. In another embodiment, the material of the cushion member 14 and the base member 12 can be generally the same hardness.

Unless the context clearly requires otherwise, throughout the description and the claims, the words "comprise," "comprising," and the like are to be construed in an inclusive sense, as opposed to an exclusive or exhaustive sense: that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An exercise device comprising:

a base member that includes an upper surface and a cushion seat portion extending downwardly therefrom, wherein the base member includes a rim portion that has an outer circumferential surface, wherein the upper surface includes a handle cavity that is open to the upper surface, and wherein the handle cavity is centrally located with respect to the outer circumferential surface of the rim portion, a cushion member attached to the cushion seat portion, wherein the cushion seat portion has a generally convex shape, a handle portion secured to the base member and spanning a diameter of the handle cavity, wherein the handle portion is configured to be grasped by a user's hand, and first and second binding member that are connected to the outer circumferential surface of the rim portion wherein the first and second binding members are movable between a stowed position where the first and second binding members extend circumferentially about a portion of the outer circumferential surface and a deployed position where the first and second binding members extend over the upper surface of the base member and are configured to secure a user's foot to the upper surface of the base member, wherein the first binding member and second binding member oppose one another about the outer circumferential surface when in a stowed position, wherein the base member includes a seat flange extending circumferentially outwardly from the rim portion at a position below the upper surface, wherein the first and second binding members rest on the seat flange and are positioned completely below the upper surface of the base member when the first and second binding members are in the stowed position.

2. The exercise device of claim 1 wherein the base member includes a lower base portion directly connected to an upper base portion, wherein the handle cavity is defined in the upper base portion and the cushion member is secured to the lower base portion.

3. The exercise device of claim 2 wherein the cushion member includes an inner surface having a channel defined therein, wherein the lower base portion includes a cushion member flange extending circumferentially therearound, and wherein the cushion member flange is received in the channel.

4. The exercise device of claim 3 wherein the upper base portion includes a generally convex protrusive portion extending downwardly therefrom, wherein the protrusive portion is matingly received in a cushion seat recess defined in the lower base portion.

5. The exercise device of claim 1 wherein the base member includes opposing handle connection recesses defined on opposite sides of the handle cavity, wherein opposite ends of the handle are received in the opposing handle connection recesses, and wherein an upper surface of the handle is generally flush with the upper surface of the base member.

6. The exercise device of claim 1 wherein the cushion member is generally dome-shaped.

7. The exercise device of claim 1 wherein the cushion member includes a plurality of bumps on an outer surface thereof.

8. A method of exercising, the method comprising the steps of:

providing a first exercise device that includes a base member having a cushion member extending downwardly therefrom, wherein the cushion member has a generally convex shape, wherein the base member includes a handle cavity defined therein that is open to an upper surface thereof, a handle portion secured to the base member and spanning a diameter of the handle cavity, and connected to the outer circumferential surface of the rim portion at least a first binding member that is wherein the first binding member is configured to secure a user's foot to the upper surface of the base member, providing a second exercise device that includes a base member having a cushion member extending downwardly therefrom, wherein the cushion member has a generally convex shape, wherein the base member includes a handle cavity defined therein that is open to an upper surface thereof, a handle portion secured to the base member and spanning a diameter of the handle cavity, and at least a first binding member that is separate from the handle portion and that is secured to the base member, wherein the first binding member is configured to secure a user's foot to the upper surface of the base member, grasping the first exercise device by the handle portion, grasping the second exercise device by the handle portion, performing a first balance exercise, releasing the handle portion of the first exercise device, releasing the handle portion of the second exercise device placing a foot on the upper surface of the base member of the first exercise device and securing the foot thereto with the first binding member, placing a foot on the upper surface of the base member of the second exercise device and securing the foot thereto with the first binding member, and performing a second balance exercise.

9. The method of claim 8 wherein the first and second exercise devices each further comprise a second binding member secured to the base member, wherein the base member includes a rim portion that has an outer circumferential surface, and wherein the first and second binding members are movable between a stowed position wherein the first and second binding members extend circumferentially about a portion of the outer circumferential surface and a deployed position where the first and second binding members extend over the upper surface of the base member.

10. The method of claim 9 further comprising the steps of pivoting the first and second binding members of the first exercise device from the stowed position to the deployed position before the step of placing a foot on the upper surface of the base member, and pivoting the first and second binding members of the second exercise device from the stowed position to the deployed position before the step of placing a foot on the upper surface of the base member.

11. The method of claim 10 wherein the first binding member and second binding member on each of the first and second exercise devices oppose one another about the outer circumferential surface when in a stowed position.

12. An exercise device comprising:

a base member that includes an upper base portion and a lower base portion, wherein the upper base portion includes an upper surface, a rim portion having an outer circumferential surface, and a downwardly extending generally convex protrusive portion, wherein a handle cavity that is open to the upper surface is defined in the upper base portion, wherein the lower base portion includes a cushion seat recess that matingly receives the protrusive portion of the upper base portion, a cushion member flange, and a cushion seat portion extending downwardly therefrom, wherein the handle cavity is centrally located with respect to the outer circumferential surface of the rim portion a cushion member that includes an inner surface and an outer surface, wherein the inner surface includes a channel that receives the cushion member flange to secured the cushion member to the lower base portion, wherein the cushion seat portion has an outer surface and a generally convex shape, and wherein the inner surface of the cushion member is in contact with the outer surface of the cushion seat portion, a handle portion secured to the base member and spanning a diameter of the handle cavity; and first and second binding members pivotably secured to the base member, wherein the first and second binding members are movable between a stowed position wherein the first and second binding members extend circumferentially about a portion of the outer circumferential surface and a deployed position where the first and second binding members extend over the upper surface of the base member and are configured to secure a user's foot to the upper surface of the base member.

13. The exercise device of claim 12 wherein the first binding member and second binding member oppose one another about the outer circumferential surface when in a stowed position.

14. The exercise device of claim 13 wherein the upper base portion includes a seat flange extending circumferentially outwardly from the rim portion, wherein the first and second binding members rest on the seat flange and are positioned below the upper surface of the base member when the first and second binding members are in the stowed position.

15. The exercise device of claim 12 wherein the upper base portion includes opposing handle connection recesses defined on opposite sides of the handle cavity, wherein opposite ends of the handle are received in the opposing handle connection recesses, and wherein an upper surface of the handle is generally flush with an upper surface of the base portion.

16. The exercise device of claim 15 wherein the cushion member is generally dome-shaped.

17. The exercise device of claim 12 wherein the cushion member includes a plurality of bumps on an outer surface thereof.

* * * * *